US008013510B2

(12) United States Patent
Xiao et al.

(10) Patent No.: US 8,013,510 B2
(45) Date of Patent: Sep. 6, 2011

(54) ELECTRON EMISSION DEVICE AND DISPLAY DEVICE USING THE SAME

(75) Inventors: Lin Xiao, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 371 days.

(21) Appl. No.: 12/317,999

(22) Filed: Dec. 31, 2008

(65) Prior Publication Data

US 2009/0195138 A1 Aug. 6, 2009

(30) Foreign Application Priority Data

Feb. 1, 2008 (CN) ..... 2008 1 0066038

(51) Int. Cl.
*H01J 19/30* (2006.01)

(52) U.S. Cl. ..... 313/495; 313/497; 313/308; 313/310; 313/311

(58) Field of Classification Search ..... None
See application file for complete search history.

(56) References Cited

U.S. PATENT DOCUMENTS 6,630,772 B1 10/2003 Bower et al.
6,943,493 B2 * 9/2005 Uemura et al. ..... 313/495
7,319,288 B2 * 1/2008 Liu et al. ..... 313/309
7,569,158 B2 8/2009 Waller et al.
2001/0019238 A1 9/2001 Dai et al.
2005/0215165 A1 9/2005 Uemura et al.
2005/0275331 A1 * 12/2005 Takai et al. ..... 313/311
2006/0066202 A1 3/2006 Manohara et al.
2007/0075619 A1 4/2007 Jiang et al.
2008/0020499 A1 1/2008 Kim et al.
2008/0036358 A1 2/2008 Takai
2009/0115305 A1 5/2009 Segal et al.

FOREIGN PATENT DOCUMENTS

CN 1428813 A 7/2003
CN 1781968 A 6/2006

* cited by examiner

*Primary Examiner* — Ashok Patel
(74) *Attorney, Agent, or Firm* — Altis Law Group, Inc.

(57) ABSTRACT

An electron emission device includes a cathode device and a gate electrode. The gate electrode is separated and insulted from the cathode device. The gate electrode includes a carbon nanotube layer having a plurality of spaces. A display device includes a cathode device, an anode device spaced from the cathode electrode and a gate electrode. The gate electrode is disposed between the cathode device and the anode device. The cathode device, the anode device and the gate electrode are separated and insulted from each other. The gate electrode comprises a carbon nanotube layer having a plurality of spaces.

20 Claims, 4 Drawing Sheets

ELECTRON EMISSION DEVICE AND DISPLAY DEVICE USING THE SAME

RELATED APPLICATIONS

This application is related to applications entitled, "ELECTRON EMISSION DEVICE AND DISPLAYING DEVICE USING THE SAME", filed Dec. 31, 2008 Ser. No. 12/319,047; "ELECTRON EMISSION DEVICE AND DISPLAYING DEVICE USING THE SAME", filed Dec. 31, 2008 Ser. No. 12/319,048. The disclosure of the respective above-identified application is incorporated herein by reference.

BACKGROUND

1. Technical Field

The invention relates to an electron emission device and a display device using the electron emission device.

2. Discussion of Related Art

Electron emission displays are new, rapidly developing in flat panel display technologies. Compared to conventional technologies, e.g., cathode-ray tube (CRT) and liquid crystal display (LCD) technologies, Field Electron emission Displays (FEDs) are superior in having a wider viewing angle, low energy consumption, a smaller size, and a higher quality display.

Generally, FEDs can be roughly classified into diode type structures and triode type structures. Diode type FEDs has only two electrodes, a cathode and an anode. Diode type FEDs can be used for character display, but are unsatisfactory for applications requiring high-resolution display images, because of they are relatively non-uniform and there is difficulty in controlling their electron emission.

Triode type FEDs were developed from the diode type by adding a gate electrode for controlling electron emission. Triode type FEDs can emit electrons at relatively lower voltages. A conventional triode type electron emission device includes a cathode electrode, a gate electrode spaced from the cathode electrode. Generally, an insulating layer is deposited on the cathode electrode for supporting the gate electrode, e.g., the gate electrode is formed on a top surface of the insulating layer. The cathode electrode includes an emissive material, such as carbon nanotube. The gate electrode includes a plurality of holes toward the emissive material, these holes are called gate holes. In use, different voltages are applied to the cathode electrode and the gate electrode. Electrons are emitted from the emissive material, and then travel through the gate holes in the gate electrode.

The conventional gate electrode is a metal grid, the metal grid has a plurality of gate holes. It is well known that the small size gate holes make for a more efficient high-resolution electron emission device. Generally, the metal grid can be fabricated using screen-printing or chemical etching methods. Areas of the gate holes in the metal grid are often more than 100 $\mu m^2$, so the electron emission device cannot satisfy some needs requiring great accuracy. The uniformity of the electric field cannot be improved by decreasing the size of the gate holes, and thus, restricts the performance of electron emission. Further, the method for making the metal grid requires an etching solution, and the etching solution may be harmful to the environment. Additionally, the grid made by metal material is relatively heavy, and restricts applications of the electron emission device.

What is needed, therefore, is an efficient high resolution electron emission device and a display device using the same.

BRIEF DESCRIPTION OF THE DRAWINGS

Many aspects of the electron emission device and the display device can be better understood with references to the following drawings. The components in the drawings are not necessarily drawn to scale, the emphasis instead being placed upon clearly illustrating the principles of the present electron emission device and the display device.

Corresponding reference characters indicate corresponding parts throughout the several views. The exemplifications set out herein illustrate at least one embodiment of the present electron emission device and display device using the same.

DETAILED DESCRIPTION OF EXEMPLARY EMBODIMENTS

References will now be made to the drawings to describe the exemplary embodiments of the electron emission device and display device using the same, in detail.

Figure 1:
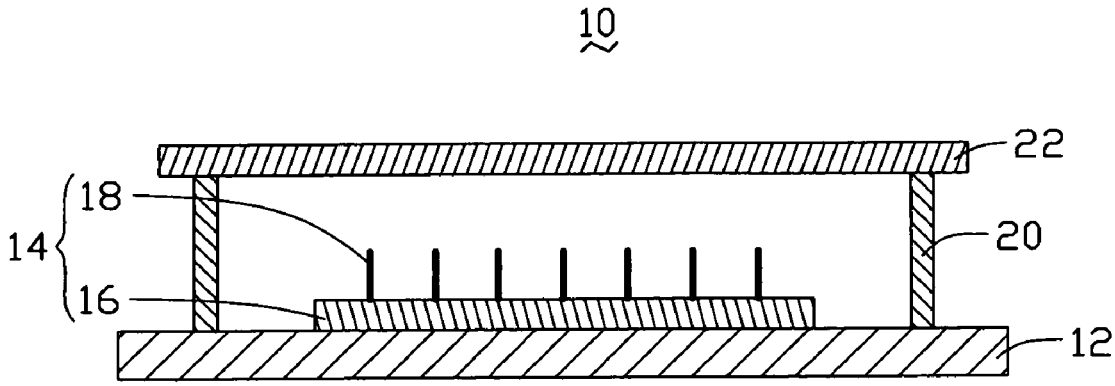
FIG. 1 is a schematic, cross-sectional view, showing an electron emission device, in accordance with a present embodiment.

Referring to FIG. 1, an electron emission device 10 includes a substrate 12, a cathode electrode 14, and an insulting supporter 20. The cathode electrode 14 and the insulting supporter 20 are disposed on the substrate 12. Further included is a gate electrode 22 formed on a top surface of the insulting supporter 20. The gate electrode 22 is electrically insulted from the cathode electrode 14 by the insulating supporter 20.

The substrate 12 includes a sheet of insulative plate composed of an insulating material, such as glass, silicon, ceramic, etc. The substrate 12 is used to support the cathode electrode 14. The shape of the substrate 12 can be determined according to practical needs. In the present embodiment, the substrate 12 is a ceramic substrate.

The cathode electrode 14 can be a field emission cathode electrode or a hot emission cathode electrode, the detailed structure of the cathode electrode 14 is not limited. The cathode electrode 14 includes at least one electron emitter. When more than one electron emitter is used, they can be configured to form an array or any other pattern. In the present embodiment, the cathode electrode 14 is a field emission cathode electrode. The cathode electrode 14 includes a conductive layer 16 and a plurality of electron emitters 18 disposed thereon. The conductive layer 16 is located on the substrate 12. The electron emitters 18 are electrically connected to the conductive layer 16. The material of the conductive layer 16 is made of metal, alloy, indium tin oxide (ITO) or any other suitable conductive materials. The electron emitters 18 can be selected from the group of silicon needles, metal needles or carbon nanotubes (CNTs). In the present embodiment, the conductive layer 16 is an ITO film, the electron emitters 18 are CNTs.

The insulating supporter 20 is used to support the gate electrode 22. The detailed shape of the insulating supporter 20 is not limited; the only requirement is that the gate electrode 22 and the cathode electrode 14 are insulated from each other. The insulating supporter 20 is made of an insulating material, such as glass, silicon, ceramic, etc. In the present embodiment, the insulating supporters 20 comprise of glass. The insulating supporter 20 is separately disposed on the two sides of the cathode electrode 14 and perpendicular to the cathode electrode 14.

Figure 2:
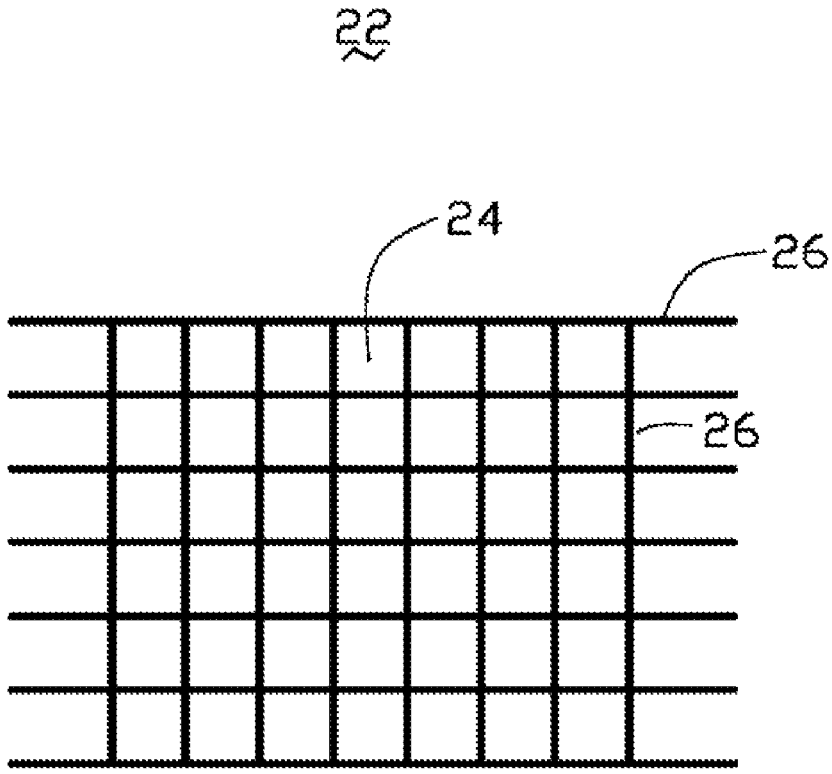
FIG. 2 is a schematic, top view, showing gate structure using a CNT layer, used in the electron emission device of FIG. 1.

Referring FIG. 2, the gate electrode 22 is a free-standing CNT layer. The CNT layer includes a plurality of CNTs 26. The CNTs 26 in the CNT layer substantially uniformly distributed. The CNT layer includes a plurality of pores, such as spaces 24. The spaces 24 are used as the gate holes. The spaces 24 are substantially uniformly distributed in the CNT layer. Areas of the spaces 24 range from about 1 $nm^2$ to about 100 $\mu m^2$. The thickness of the CNT layer is in a range from about 1 nm to about 100 μm.

Figure 3:
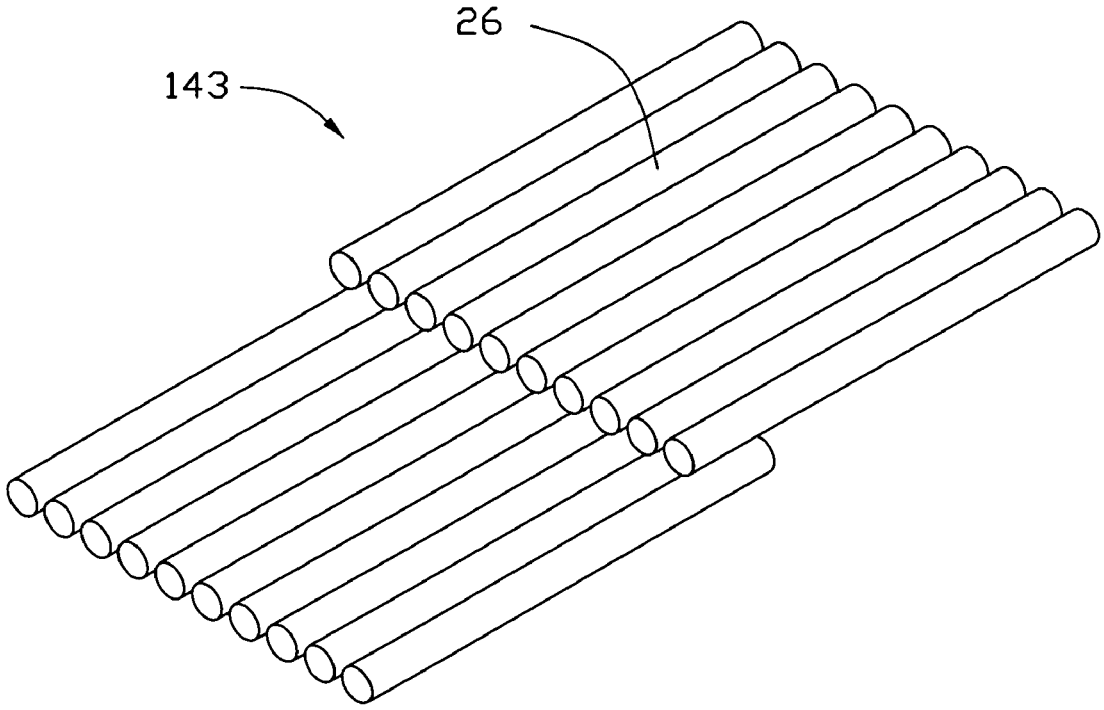
FIG. 3 is a structural schematic of a carbon nanotube segment.

The CNT layer comprises of one CNT film or several layers of CNT films. Each CNT film includes a plurality of CNTs arranged along a same direction (e.g., collinear and/or parallel). The CNTs 26 in the CNT film are joined by van der Waals attractive force therebetween. Referring to FIG. 3, the CNT film includes a plurality of successively oriented CNT segments 143 joined end-to-end by van der Waals attractive force therebetween. Each CNT segment 143 includes a plurality of CNTs 26 in parallel, and combined by van der Waals attractive force therebetween. The CNT segments 143 can vary in width, thickness, uniformity and shape. The CNTs 26 in the CNT segment 143 are also oriented along a preferred orientation. When the CNT layer includes at least two CNT films, the CNTs 26 in different CNT films can be aligned along a same direction, or aligned along a different direction. An angle $\alpha$ between the alignment directions of the CNTs in each two adjacent CNT films is in the range $0 \leqq \alpha \leqq 90°$. A thickness of the CNT film is in a range from about 0.5 nm to about 10 μm.

The CNTs 26 in the CNT film can be selected from a group consisting of single-walled, double-walled, and multi-walled CNTs. A diameter of each single-walled CNT ranges from about 0.5 nm to about 50 nm. A diameter of each double-walled CNT ranges from about 1 nm to about 50 nm. A diameter of each multi-walled CNT ranges from about 1.5 nm to about 50 nm. A length of the CNTs 26 is in a range from about 10 μm to about 5000 μm.

When the CNT layer includes one CNT film, the spaces 24 are linear and the spaces are between two adjacent CNTs 26. The electrons are emitted from the electron emitters and travel through the spaces in the gate electrode (i.e., the spaces of the CNT layer). Because the CNTs 26 in the CNT film are distributed uniformly, the spaces 24 in the CNT layer are substantially uniformly distributed as well.

When the CNT layer includes at least two CNT films, an angle $\alpha$ between the alignment directions of the CNTs in each two adjacent CNT films is in the range from about 0 degrees to about 90 degrees. Thus, the spaces are defined by the crossed, CNTs in two adjacent CNT films. Areas of the spaces can be in the range from about 1 $nm^2$ to about 100 $\mu m^2$. It is to be understood that, the area of the spaces 24 is decided by the number of the CNT films and the angle $\alpha$ between each two adjacent CNT films. The electrons emitted from the electron emitters travel through the spaces 24 in the gate electrode. Because the CNTs 26 in the CNT layer substantially uniformly distributed, the spaces 24 in the CNT layer are substantially uniformly distributed as well.

In the present embodiment, the gate electrode 22 includes two stacked CNT films. The angle $\alpha$ between the directions of the CNTs 26 in the two CNT films is about 90°. The area of spaces 24 is about 100 $\mu m^2$.

In operation, different voltages can be respectively applied to the cathode electrode 14 and the gate electrode 22 (Usually, the voltage of the cathode electrode 14 is zero and may be electrically connected to ground. The voltage of the gate electrode 22 is positive and ranges from tens of volts to hundreds of volts). The electrons can be extracted from the cathode electrode 14 by an electric field generated by the gate electrode 22 and the cathode electrode 14, and then the electrons travel through the spaces 24 in the gate electrode 22. In the present embodiment, the gate electrode 22 is a CNT layer. The CNT layer includes a plurality of spaces 24. The area of the spaces 24 is approximately ranged from about 1 $nm^2$ to about 100 $\mu m^2$. The spaces are substantially uniformly distributed and have small areas. Therefore, a uniform electric field can be formed between the cathode electrode 14 and the gate electrode 22. Thus, the electron emission device and the display device using the same have a high efficiency and a high-resolution. Further, due to the CNT layer having a lower density compared with metal, the electron emission device 10 is relatively light, and the electron emission device 10 can be easily used in a broader range of technologies.

Figure 4:
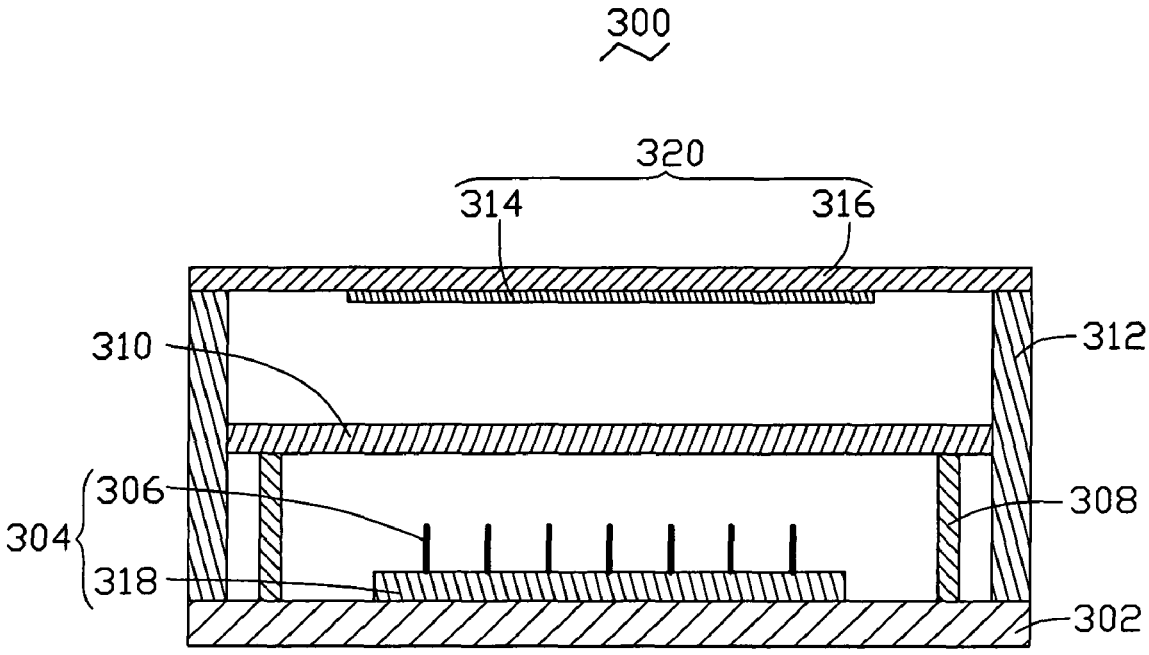
FIG. 4 shows is a schematic, cross-sectional view, showing a display device, in accordance with a present embodiment.

Referring to FIG. 4, a display device 300 employing the above-described electron emission device 10, according to another embodiment, is shown. The display device 300 includes a substrate 302, a cathode electrode 304 and a first insulating supporter 308 disposed on the substrate 302, a gate electrode 310 formed on a top surface of the first insulating supporter 308. The gate electrode 310 is electrically insulted from the cathode electrode 14 by the first insulting supporter 308. Further included are a second insulting supporter 312, disposed on the substrate 302, and an anode device 320 formed on a top surface of the second insulting supporter 312. The anode device 320 is electrically insulted from the cathode electrode 304 and the gate electrode 310 by the second insulating supporter 312.

The second insulating supporter 312 is used to support the anode device 320. The detailed shape of the second insulating supporter 312 is not limited, as long as the anode device is insulated from the cathode electrode 304 and the gate electrode 310. The second insulating supporter 312 is made of an insulation material, such as glass, silicon, ceramic, etc. In the present embodiment, the second insulating supporter 312 is made of glass. The second insulating supporter 312 is disposed on the substrate 302 and is longer than the first insulating supporter 308.

The anode device 320 includes an anode electrode 314 and a fluorescence layer 316. The anode device 320 is above the gate electrode 310. The fluorescence layer 316 is on a surface of the anode electrode 314 facing the gate electrode. The fluorescence layer 316 can be formed by a coating method.

The cathode electrode 314 can be field emission cathode electrode or hot emission cathode electrode. The detailed structure of the cathode electrode 314 is not limited. The cathode electrode includes at least one electron emitter 306. The structure of electron emitter is not limited, and may be one or more films or it can be arranged in an array. In the present embodiment, the cathode electrode 314 is field emission cathode electrode. The cathode electrode 314 includes a conductive layer 318 and a plurality of electron emitters 306 dispose thereon. The conductive layer 318 lays on the substrate 302, the electron emitters 306 are electrically connected to the conductive layer 318. The material of the conductive layer 318 is made of metal or any other suitable conductive materials. The electron emitters 306 can be selected from the group of silicon needles, metal needles or CNTs. In the present embodiment, the conductive layer 318 is an ITO film, the electron emitters 306 are CNTs.

The gate electrode 310 is a CNT layer. The structure of the CNT layer is similar to the CNT layer used in the electron emission device 10. The CNT layer includes a plurality of spaces. The spaces are used as gate holes. The spaces are distributed substantially uniformly in the CNT layer. The area of the spaces ranges from about 1 $nm^2$ to about 100 $\mu m^2$. The thickness of the CNT layer is in an approximate range from about 1 nm to about 100 μm.

In operation, different voltages can be respectively applied to the anode electrode 314, the cathode electrode 304, and the gate electrode 310. Usually, the voltage of the cathode electrode 14 is zero and may be electrically connected to ground. The voltage of the gate electrode 22 is positive. The electrons can be extracted from the cathode electrode 314 by an electric field generated by gate electrode 310 and the cathode electrode 314, and then the electrons travel through the spaces in the gate electrode 310, then reach the fluorescence layer 316 on the surface of the anode electrode 314, and the fluorescence layer 316 emits visible-light. As the gate electrode 310 is a carbon nanotube layer, the CNT layer includes a plurality of spaces. The area of the spaces is ranged from 1 $nm^2$ to 100 $\mu m^2$. The spaces are substantially uniformly distributed and have small diameters, so the electron emission device and the display device have a high efficiency and a high-resolution.

It is to be understood that, the structures of electrode device and the anode device are not limited. The display device can be also used as a flat light source.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electron emission device comprising:

a cathode electrode; and a gate electrode, the gate electrode being separated and insulated from the cathode electrode, wherein the gate electrode comprises a carbon nanotube layer having a plurality of spaces substantially uniformly distributed.

2. The electron emission device as claimed in claim 1, wherein an area of the spaces is ranged from 1 $nm^2$ to 10 $\mu m^2$.

3. The electron emission device as claimed in claim 1, wherein the cathode electrode is a field emission cathode electrode or a hot emission cathode electrode.

4. The electron emission device as claimed in claim 1, wherein a thickness of the carbon nanotube layer ranges from about 1 nm to about 100 μm.

5. The electron emission device as claimed in claim 1, wherein the carbon nanotube layer comprises at least one carbon nanotube film.

6. The electron emission device as claimed in claim 1, wherein a thickness of the carbon nanotube film ranges from about 1 nm to about 10 μm.

7. The electron emission device as claimed in claim 1, wherein the at least one carbon nanotube film comprises a plurality of carbon nanotubes arranged in substantially the same direction.

8. The electron emission device as claimed in claim 5, wherein the at least one carbon nanotube film comprises a plurality of successively oriented carbon nanotube segments joined end-to-end by van der Waals attractive force therebetween.

9. The electron emission device as claimed in claim 8, wherein each carbon nanotube segment comprises a plurality of carbon nanotubes parallel to each other, and combined by van der Waals attractive force therebetween.

10. The electron emission device as claimed in claim 9, wherein the carbon nanotubes in the at least one carbon nanotube film are selected from the group consisting of single-walled, double-walled, and multi-walled carbon nanotubes.

11. The electron emission device as claimed in claim 10, wherein a diameter of each single-walled carbon nanotube approximately ranges from 0.5 nm to 50 nm, a diameter of each double-walled carbon nanotube approximately ranges from 1 nm to 50 nm, a diameter of each multi-walled carbon nanotube approximately ranges from 1.5 nm to 50 nm.

12. The electron emission device as claimed in claim 10, wherein a length of the carbon nanotubes is in a range from about 10 μm to about 5000 μm.

13. The electron emission device as claimed in claim 1, wherein when the carbon nanotube layer includes two or more carbon nanotube films, the carbon nanotubes in two or more carbon nanotube films can be aligned along a same direction or aligned along different directions.

14. The electron emission device as claimed in claim 13, wherein there is an angle $\alpha$ between the alignment directions of the carbon nanotubes in each two adjacent carbon nanotube films, wherein 0 degress$\leqq\alpha\leqq$90 degrees.

15. A display device comprising:

a cathode electrode comprising at least one emitter;

an anode device spaced from the cathode electrode; and a gate electrode disposed between the cathode device and the anode device;

wherein the cathode device, the anode device and the gate electrode are insulated from each other, and the gate electrode comprises a carbon nanotube layer having a plurality of spaces substantially uniformly distributed.

16. The display device as claimed in claim 15, wherein an area of the spaces is ranged from 1 $nm^2$ to 100 $\mu m^2$.

17. The display device as claimed in claim 15, wherein cathode electrode is a field emission cathode electrode or a hot emission cathode electrode.

18. The display device as claimed in claim 15, wherein a thickness of the carbon nanotube layer ranges from about 1 nm to about 100 μm.

19. The electron emission device as claimed in claim 15, wherein the carbon nanotube layer comprises at least one carbon nanotube film.

20. The electron emission device as claimed in claim 19, wherein the at least one carbon nanotube film comprises a plurality of carbon nanotubes arranged in substantially the same direction.

* * * * *